US011713203B2

(12) United States Patent
Nakamura et al.

(10) Patent No.: US 11,713,203 B2
(45) Date of Patent: Aug. 1, 2023

(54) SHEET STORAGE DEVICE, IMAGE PROCESSING APPARATUS INCLUDING SHEET STORAGE DEVICE, AND SHEET POSITIONING MEMBER

(71) Applicant: KYOCERA Document Solutions Inc., Osaka (JP)

(72) Inventors: Arata Nakamura, Osaka (JP); Dang Long Bui, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 218 days.

(21) Appl. No.: 17/285,017

(22) PCT Filed: Oct. 18, 2019

(86) PCT No.: PCT/JP2019/041141
§ 371 (c)(1),
(2) Date: Apr. 13, 2021

(87) PCT Pub. No.: WO2020/100526
PCT Pub. Date: May 22, 2020

(65) Prior Publication Data

US 2021/0395027 A1 Dec. 23, 2021

(30) Foreign Application Priority Data

Nov. 13, 2018 (JP) ..... 2018-213212

(51) Int. Cl.
*B65H 1/26* (2006.01)
*B65H 1/04* (2006.01)
*B65H 1/12* (2006.01)

(52) U.S. Cl.
CPC ..... *B65H 1/266* (2013.01); *B65H 1/04* (2013.01); *B65H 1/12* (2013.01); *B65H 2405/11* (2013.01);

(Continued)

(58) Field of Classification Search
CPC .... B65H 1/04; B65H 1/266; B65H 2405/114; B65H 2405/1142; B65H 2405/1144; B65H 2511/12
See application file for complete search history.

(56) References Cited

U.S. PATENT DOCUMENTS

2004/0135306 A1* 7/2004 Takahashi ..... B65H 1/04 271/145
2004/0188924 A1* 9/2004 Ito ..... B65H 1/266 271/171

(Continued)

FOREIGN PATENT DOCUMENTS

JP H09183522 A 7/1997
JP 2008030902 A 2/2008

*Primary Examiner* — Prasad V Gokhale
(74) *Attorney, Agent, or Firm* — Alleman Hall Creasman & Tuttle LLP

(57) ABSTRACT

A sheet storage device includes a sheet positioning member that is movable in a first direction, and positions a sheet by abutting on a side end portion of the sheet at a side in the first direction. The sheet positioning member includes a moving body, an abutting portion, a first and a second biasing member, and a bias removing portion. The moving body is configured to move in the first direction. The abutting portion is supported by the moving body to be movable in the first direction and configured to abut on the side end portion when the sheet positioning member positions the sheet. The first biasing member biases the abutting portion toward the side end portion. The second biasing member biases the abutting portion against a biasing force of the first biasing member. The bias removing portion removes a bias applied by the second biasing member.

9 Claims, 16 Drawing Sheets

(52) U.S. Cl.
CPC .... *B65H 2405/114* (2013.01); *B65H 2511/12* (2013.01)

(56) References Cited

U.S. PATENT DOCUMENTS

| | | | | |
|---|---|---|---|---|
| 2015/0183606 | A1* | 7/2015 | Nishi | B65H 31/02 271/234 |
| 2017/0015512 | A1* | 1/2017 | Kawazoe | B65H 3/66 |
| 2021/0155440 | A1* | 5/2021 | Yoneyama | B65H 31/36 |

* cited by examiner

SHEET STORAGE DEVICE, IMAGE PROCESSING APPARATUS INCLUDING SHEET STORAGE DEVICE, AND SHEET POSITIONING MEMBER

TECHNICAL FIELD

The present invention relates to a sheet storage device storing a plurality of sheets, and especially relates to a mechanism configured to abut on stored sheets to position the sheets to a predetermined position.

There is known an image forming apparatus that includes a paper cassette for storing paper sheets (sheets) on which images are to be printed. The paper cassette stores a plurality of sheets. Conventionally, the paper cassette includes a positioning member (cursor) to prevent the plurality of stored sheets from being displaced from a predetermined position. The positioning member regulates a sheet stack set on an upper surface of a lift plate to the predetermined position in a width direction.

In addition, there is known a paper cassette (sheet cassette) including a positioning member (regulating member) that presses a side surface of stored sheets by an elastic force of a spring member (see PTL 1).

CITATION LIST

Patent Literature

[PTL 1] Japanese Patent Application Publication No. H9-183522

SUMMARY OF THE INVENTION

Problems to be Solved by the Invention

In a conventional technology, however, a spring member is used to bias a side surface of sheets. With such a configuration, there may be a case where, in a state where a positioning member is disposed at a position corresponding to a size of the sheets, the spring member becomes an obstacle and the user cannot store sheets in a paper cassette. In that case, the user needs to displace the positioning member outside in advance, store the sheets in the paper cassette, and then move the positioning member to a predetermined position corresponding to the size of the sheets. As understood from this, the paper setting method of the conventional technology is complicated, and the operability is not good in storing sheets in the paper cassette.

The present invention has been made in view of such conventional circumstances, and it is an object of the present invention to provide a sheet storage device in which a plurality of sheets can be stored easily in a state where a positioning member is disposed at a predetermined position, an image processing apparatus including a sheet storage device, and a sheet positioning member.

Solution to the Problems

A sheet storage device according to an aspect of the present invention includes a sheet positioning member provided on a sheet placing surface in such a way as to be movable in a predetermined first direction, the sheet positioning member positioning a sheet placed on the sheet placing surface by abutting on a side end portion of the sheet at a side in the first direction.

The sheet positioning member includes a moving body, an abutting portion, a first biasing member, a second biasing member, and a bias removing portion. The moving body is configured to move in the first direction on the sheet placing surface. The abutting portion is supported by the moving body in such a way as to be movable in the first direction and configured to abut on the side end portion when the sheet positioning member positions the sheet. The first biasing member is configured to bias the abutting portion toward the side end portion. The second biasing member is configured to bias the abutting portion in a second direction opposite to a biasing direction of the first biasing member against a biasing force of the first biasing member. The bias removing portion is configured to remove a bias applied by the second biasing member.

An image processing apparatus according to another aspect of the present invention includes the sheet storage device and an image processing portion configured to perform image processing on the sheet fed from the sheet storage device.

A sheet positioning member according to a further aspect of the present invention is provided on a sheet placing surface in such a way as to be movable in a predetermined first direction, and configured to position a sheet placed on the sheet placing surface by abutting on a side end portion of the sheet at a side in the first direction. The sheet positioning member includes a moving body, an abutting portion, a first biasing member, a second biasing member, and a bias removing portion. The moving body is supported by the sheet placing surface in such a way as to be movable in the first direction. The abutting portion is supported by the moving body in such a way as to be movable in the first direction and configured to abut on the side end portion when the sheet positioning member positions the sheet. The first biasing member is configured to bias the abutting portion toward the side end portion. The second biasing member is configured to bias the abutting portion in a second direction opposite to a biasing direction of the first biasing member against a biasing force of the first biasing member. The bias removing portion is configured to remove a bias applied by the second biasing member.

Advantageous Effects of the Invention

According to the present invention, it is possible for a plurality of sheets to be stored easily in a state where a positioning member is disposed at a predetermined position.

DESCRIPTION OF EMBODIMENTS

The following describes an embodiment of the present invention with reference to the accompanying drawings. It should be noted that the following embodiment is an example of a specific embodiment of the present invention and should not limit the technical scope of the present invention. It is noted that, for the sake of explanation, an up-down direction D1, a front-rear direction D2, and a left-right direction D3 are defined with respect to a state where an image forming apparatus 10 is usably installed (the state shown in FIG. 1).

Figure 1:
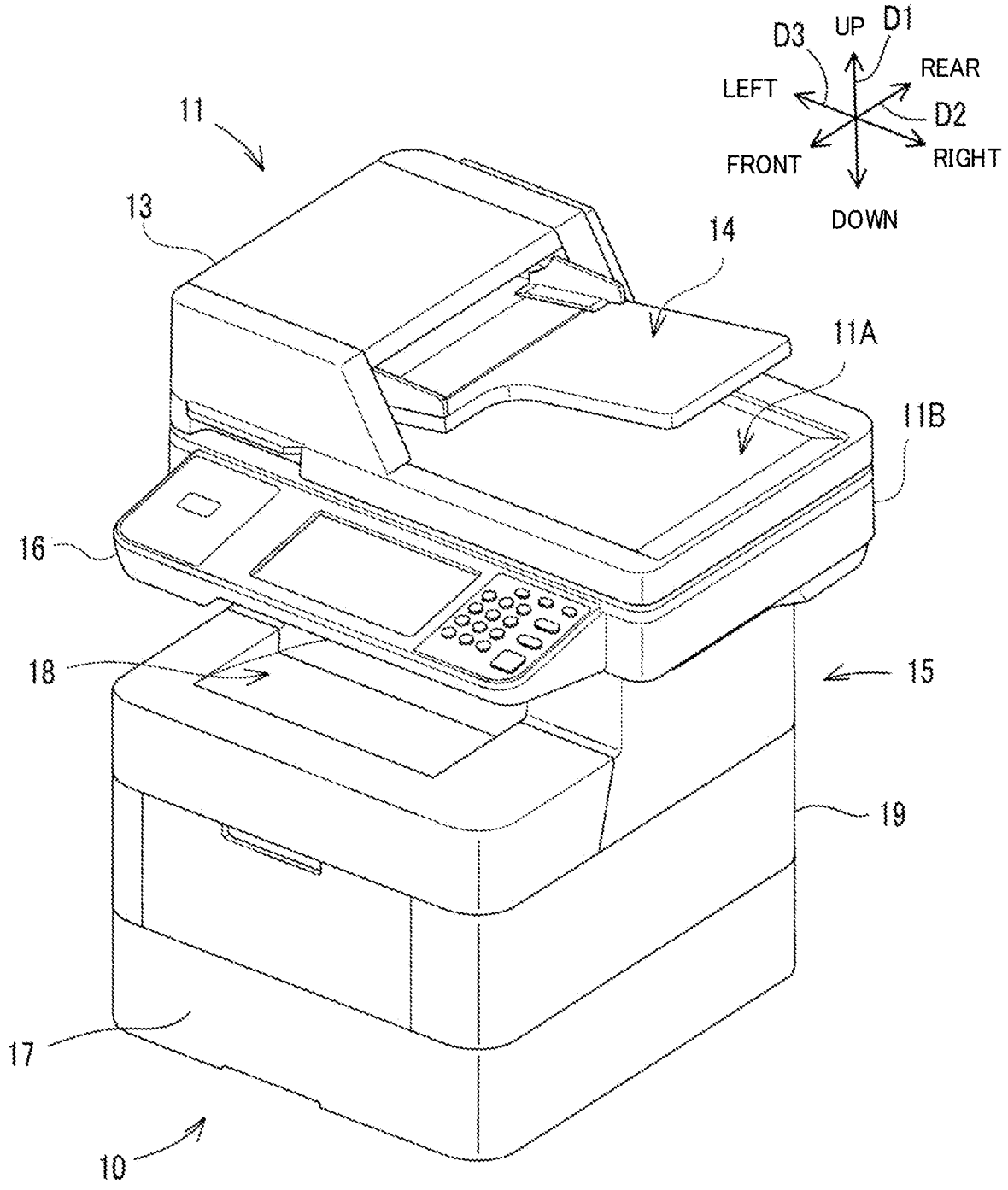
FIG. 1 is a perspective diagram showing a configuration of an image forming apparatus according to an embodiment of the present invention.

The following describes, with reference to FIG. 1, an approximate configuration of an image reading device 11 according to the embodiment of the present invention and the image forming apparatus 10 including the image reading device 11. It is noted that the image reading device 11 and the image forming apparatus 10 are each an example of an image processing apparatus of the present invention.

The image forming apparatus 10 is a multifunction peripheral having a plurality of functions such as a print function, a copy function, a scan function, and a facsimile function. FIG. 1 is a perspective diagram of the image forming apparatus 10 (an example of the image processing apparatus of the present invention) according to the embodiment of the present invention. As shown in FIG. 1, the image forming apparatus 10 includes the image reading device 11, an auto document feeder (ADF) 13, an image forming portion 15, an operation/display portion 16, a paper cassette 17, a sheet feed mechanism (not shown), and a sheet discharge portion 18.

The present embodiment describes, as one example, the image forming apparatus 10 including the image reading device 11. However, the present invention is not limited to the configuration. For example, the present invention is applicable to an image processing apparatus such as: a printer (an image forming apparatus) that includes the paper cassette 17, and has only the print function; and a scanner (an image reading device) that includes a document sheet tray 14, and has only the scan function. It is noted that in this case, the paper cassette 17 and the document sheet tray 14 are each an example of the sheet storage device of the present invention.

The image forming portion 15 executes a color or monochrome image forming process (an example of image processing) by an electrophotographic method based on image data read by the image reading device 11, or image data input from an information processing apparatus such as an external personal computer. The image forming portion 15 includes an image forming unit, an exposure device, an intermediate transfer belt, a secondary transfer roller, and a fixing device. The image forming unit includes a photoconductor drum, a charging device, a developing device, a primary transfer roller, and a cleaning device (all of these components are not shown). These components are disposed in a housing 19 that constitutes a frame of the image forming portion 15 and the like.

The present embodiment describes, as one example, the image forming portion 15 adopting the electrophotographic method. However, the method of the image forming portion 15 is not limited to the electrophotographic method, but may be an inkjet recording method or any other recording or printing method.

The ADF 13 is provided in the image reading device 11. The image reading device 11 includes the document sheet tray 14. One or more document sheets (an example of sheets of the present invention) that are the reading target, are placed on the document sheet tray 14. The ADF 13 picks up the document sheets one by one from the document sheet tray 14, and feeds them in succession to a predetermined reading position. Here, the image reading device 11 reads an image from a document sheet at the reading position, and a reading unit irradiates light to the reading position.

The document sheet tray 14 includes a cursor 14A for positioning the document sheets placed on the document sheet tray 14 to a predetermined position in the front-rear direction D2. The cursor 14A is provided on an upper surface (sheet placing surface) of the document sheet tray 14. The cursor 14A extends in a width direction (the left-right direction D3) of the document sheet tray 14 and is configured to move frontward from a rear end portion on the upper surface of the document sheet tray 14. The cursor 14A abuts on a rear end portion of a stack of document sheets placed on the document sheet tray 14, and position the stack of document sheets to the predetermined position.

The image reading device 11 is attached to an upper portion of the image forming apparatus 10. The image reading device 11 includes a reading unit, a contact member, a document sheet pressing 11A, and a housing 11B. The above-mentioned components are stored in the housing 11B of the image reading device 11. The image reading device 11 executes an image reading process (an example of the image processing) of reading image data from a document sheet. For example, the image reading device 11 executes a process of reading an image from a document sheet that has been fed by the ADF 13 and is moving, and a process of reading an image from a document sheet placed still on the contact member.

The following describes the paper cassette 17 in detail.

Figure 2:
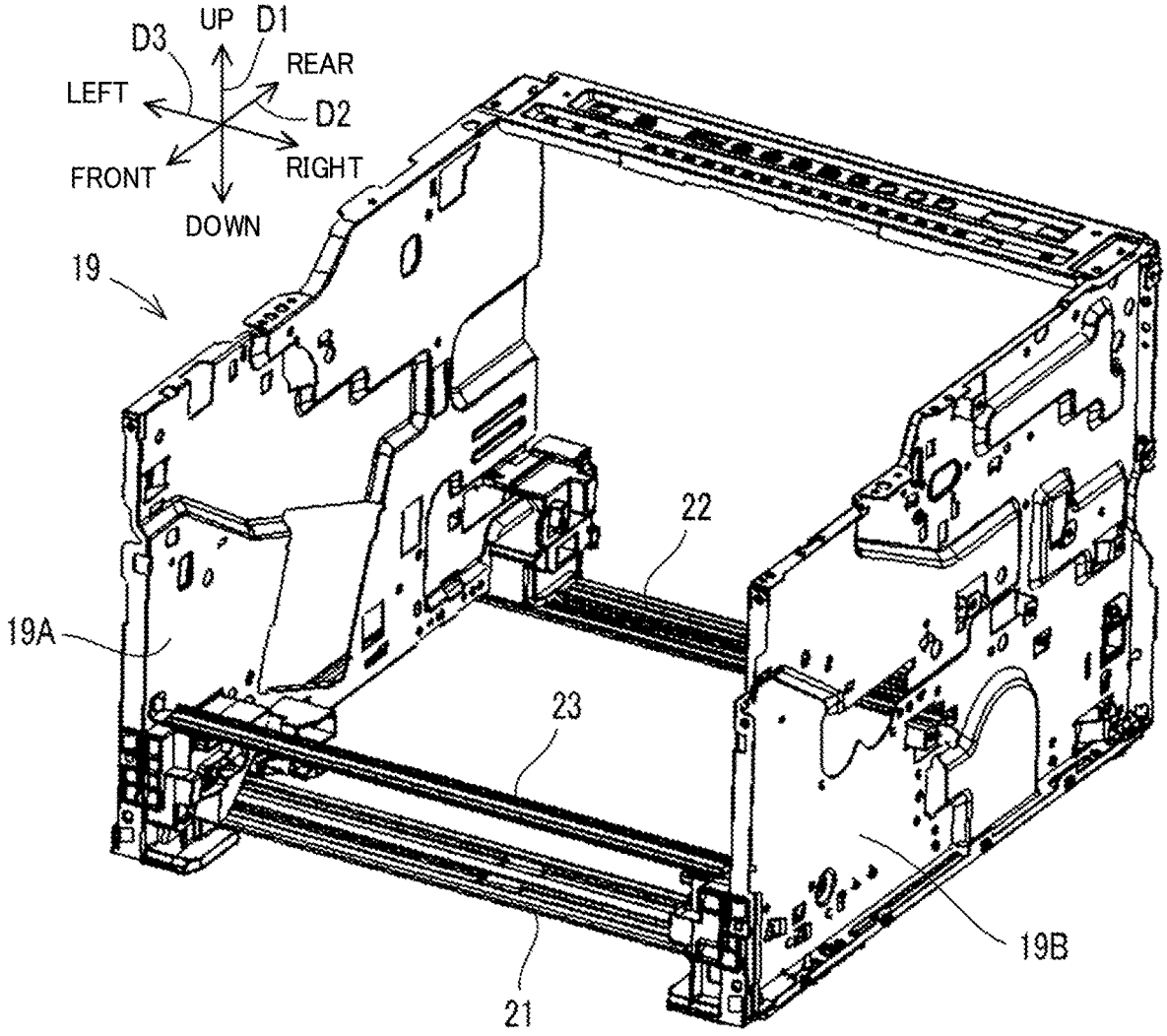
FIG. 2 is a perspective diagram of a housing of the image forming apparatus according to the embodiment of the present invention, and shows a state where a paper cassette is attached thereto.
Figure 3:
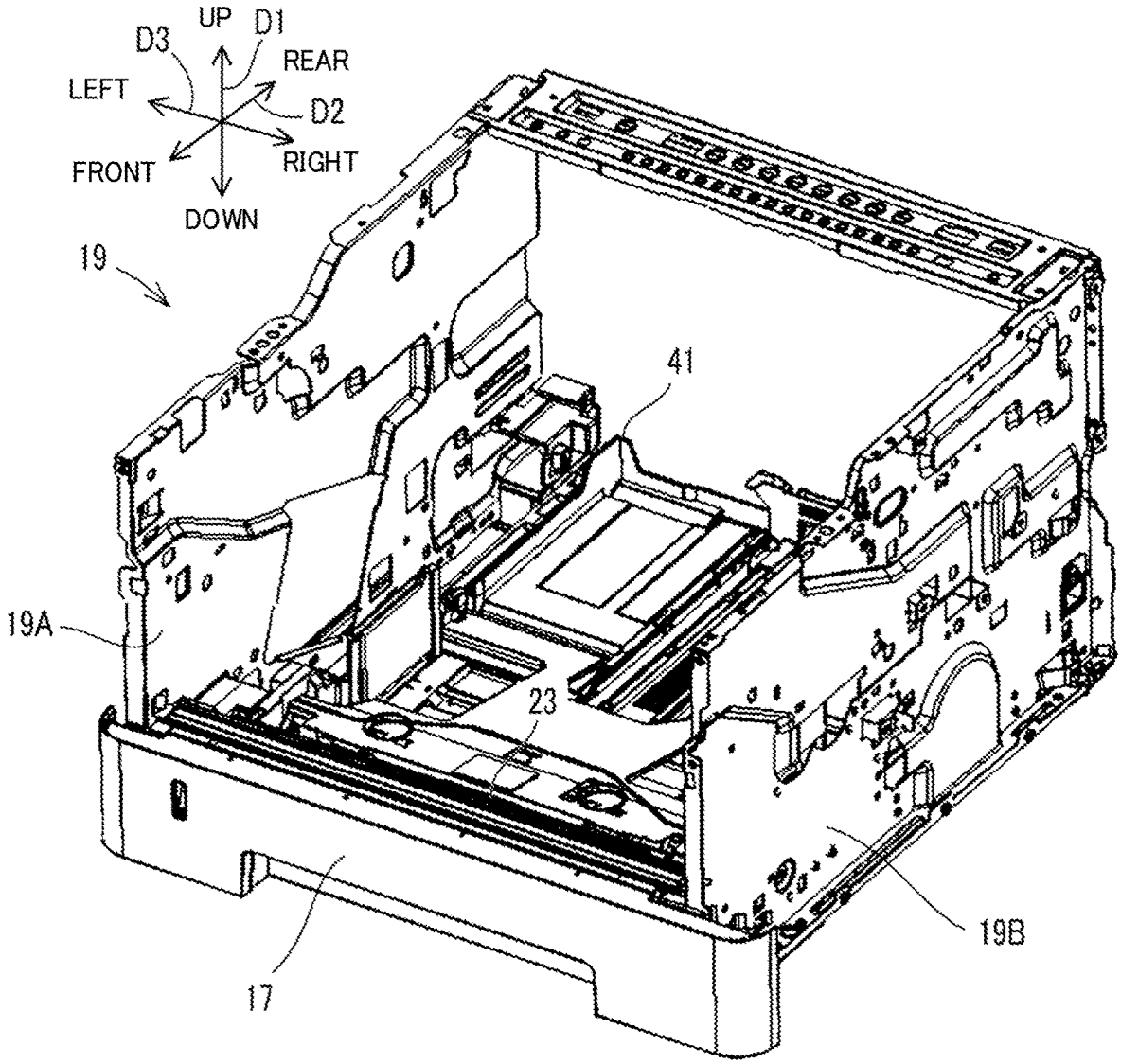
FIG. 3 is a perspective diagram of the housing of the image forming apparatus according to the embodiment of the present invention.

FIG. 2 is a perspective diagram showing a state where the paper cassette 17 is attached to the housing 19 of the image forming portion 15. FIG. 3 is a perspective diagram showing the housing 19. As shown in FIG. 1 and FIG. 2, the paper cassette 17 is provided at a lower portion of the housing 19. A plurality of print sheets (an example of the sheets of the present invention) of a predetermined size are stored in the paper cassette 17.

The housing 19 supports the paper cassette 17 such that the paper cassette 17 can be slid in and out the housing 19 in the front-rear direction D2 through a front surface of the image forming apparatus 10. The housing 19 is an example of a housing of the present invention. As shown in FIG. 2 and FIG. 3, the housing 19 includes a pair of plate-like side frames 19A and 19B that are separated from each other in the left-right direction D3. The side frames 19A and 19B are formed from metal plates. As shown in FIG. 3, a front support frame 21 (an example of a first member of the present invention) and a rear support frame 22, both extending in the left-right direction D3, are provided in a lower portion of the housing 19. The support frames 21 and 22 support, from below, the paper cassette 17 that has been inserted up to an attachment position set in the housing 19. The support frames 21 and 22 extend between the side frames 19A and 19B. The support frames 21 and 22 have the same height in the up-down direction D1.

A reinforcement frame 23 (an example of a second member of the present invention) is provided on the front side of a lower portion of the housing 19. The reinforcement frame 23 is disposed more on the front side than the front support frame 21, and separated upward from the front support frame 21 by a certain interval. The paper cassette 17 can be inserted through an opening which is surrounded by the reinforcement frame 23, the front support frame 21, and the side frames 19A and 19B. It is noted that the certain interval is a size determined to allow for insertion of the paper cassette 17.

It is noted that although the present embodiment describes, as one example, a configuration where the paper cassette 17 is inserted in and supported by the housing 19 of the image forming portion 15 in a detachable manner, another housing for supporting the paper cassette 17 may be provided independently of the housing 19. The housing includes the support frames 21 and 22, and the reinforcement frame 23. In this case, the sheet storage device of the present invention is achieved by the housing and the paper cassette 17.

Figure 4:
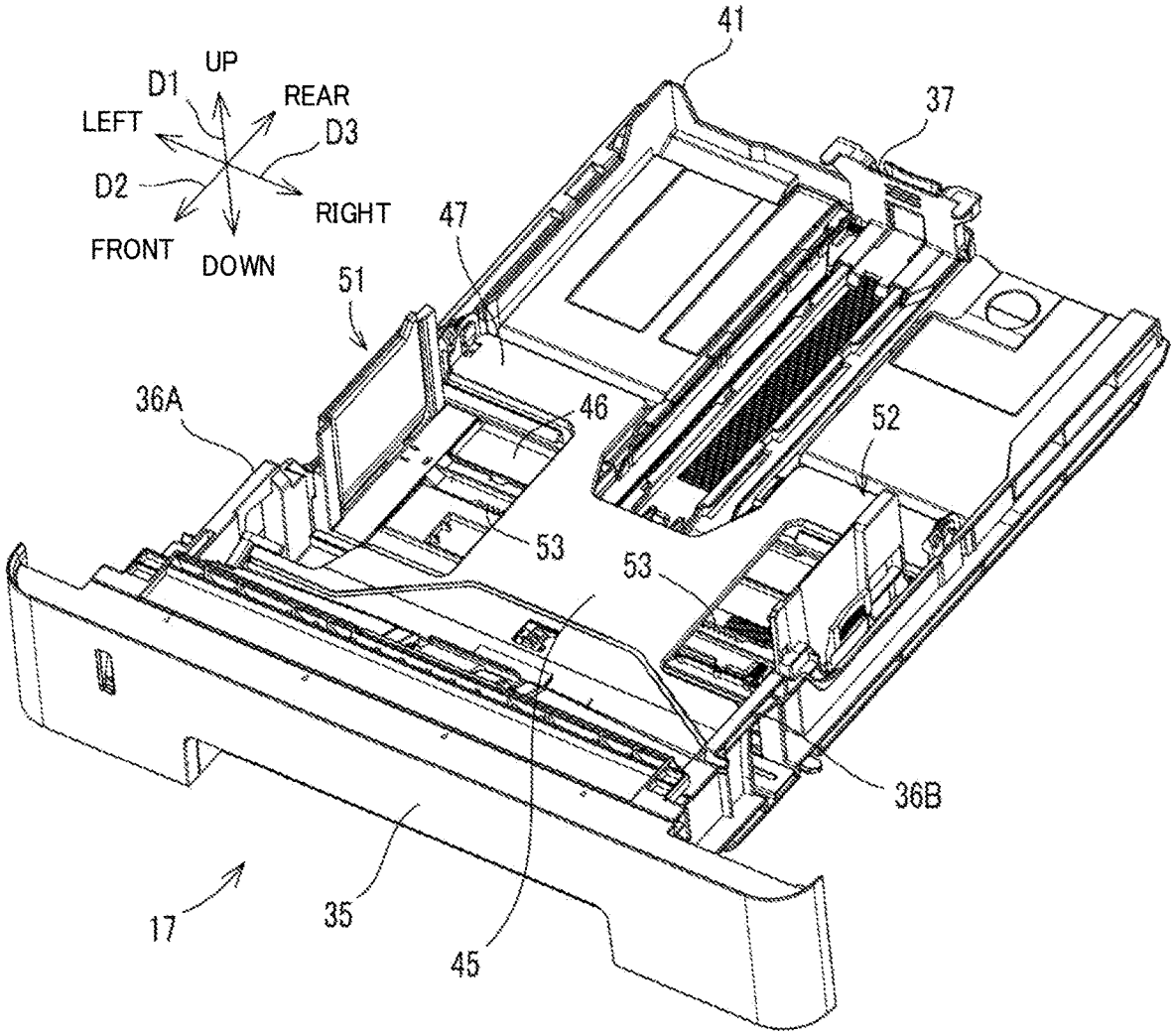
FIG. 4 is a perspective diagram showing a configuration of the paper cassette according to the embodiment of the present invention.

FIG. 4 is a perspective diagram of the paper cassette 17. The paper cassette 17 is inserted in and supported by the housing 19 in a detachable manner. As shown in FIG. 4, the paper cassette 17 includes a sheet storage portion 41 (an example of a sheet storage portion of the present invention) having a shape of a rectangular tray whose top is opened so that a plurality of print sheets can be stored therein. A plurality of print sheets are stacked in the sheet storage portion 41. A lift plate 45 is attached to a bottom plate 46 provided at the bottom of the sheet storage portion 41, wherein the lift plate 45 is configured to be raised and lowered in the up-down direction D1. The lift plate 45 is provided on the front side of the bottom plate 46. The print sheets are stacked on the lift plate 45. A rear end portion 47 of the lift plate 45 is pivotably supported by the bottom plate 46 of the sheet storage portion 41, and a front end portion of the lift plate 45 is a free end. When the lift plate 45 is displaced in the up-down direction D1, the lift plate 45 is raised and lowered in the up-down direction D1 together with the print sheets.

The sheet storage portion 41 includes: a handle portion 35 on the front side thereof, a pair of side walls 36A and 36B on the left and right sides thereof; and a regulating member 37 for regulating the rear end of the sheets, on the rear side thereof. In addition, a guide member 38 is provided between the bottom plate 46 and the handle portion 35, wherein the guide member 38 has a guide surface that guides a front end of a print sheet diagonally upward when a sheet feed mechanism (not shown) feeds the print sheet frontward from the sheet storage portion 41.

The lift plate 45 is attached to an upper surface (bottom surface) of the bottom plate 46 of the sheet storage portion 41, with an elastic member (not shown) in between. The elastic member is, for example, a coil spring or a plate spring. The lift plate 45 is always biased upward by the elastic member. With this configuration, a top sheet of the print sheets stacked on the lift plate 45 is always in contact with a pickup roller of the sheet feed mechanism.

In addition, as shown in FIG. 4, the paper cassette 17 is provided with a pair of cursors 51 and 52 for positioning the plurality of print sheets (a sheet stack). The cursors 51 and 52 are provided on the bottom plate 46 of the sheet storage portion 41 in such a way as to be movable in the width direction of the paper cassette 17 (the left-right direction D3). In the present embodiment, the cursor 51 is provided on one (left) side in the width direction of the bottom plate 46 (hereinafter, the cursor 51 is referred to as a left cursor 51), and the cursor 52 is provided on the other (right) side in the width direction of the bottom plate 46 (hereinafter, the cursor 52 is referred to as a right cursor 52). Here, the left cursor 51 is an example of a sheet positioning member of the present invention. In addition, the moving direction (the width direction) of the left cursor 51 is an example of a first direction of the present invention. The cursors 51 and 52 abut on opposite sides of the print sheets stored in the paper cassette 17 in the width direction to regulate the print sheets to a predetermined position that corresponds to the size of the print sheets in the width direction, thereby positioning the print sheets stored in the paper cassette 17 to the predetermined position.

Figure 5:
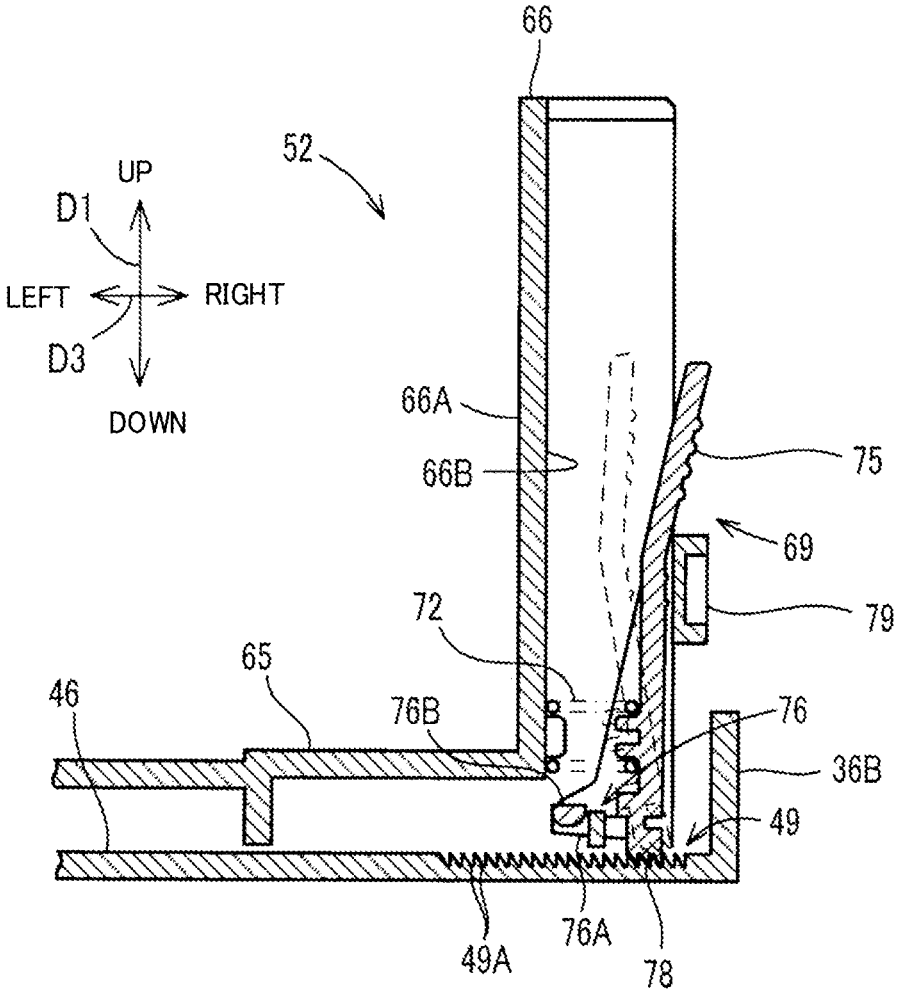
FIG. 5 is a cross section showing a configuration of a right cursor included in the paper cassette.

FIG. 5 is a cross section showing a configuration of the right cursor 52. As shown in FIG. 5, the right cursor 52 includes a flat-plate-like support plate 65 and a plate-like abutting portion 66, wherein the support plate 65 is slidably supported by the bottom plate 46, and the abutting portion 66 extends upward approximately vertically from the support plate 65. The right cursor 52 is made of, for example, a synthetic resin, and the support plate 65 and the abutting portion 66 are integrally formed with each other. The support plate 65 extends in the front-rear direction D2 along the upper surface (bottom surface) of the bottom plate 46. An inner side surface of the abutting portion 66 is referred to as an abutting surface 66A and abuts on the right side end portion of the sheet stack stored in the sheet storage portion 41. An upper surface of the support plate 65 supports an end portion (the right-side end portion) of the sheet stack in the width direction.

In the present embodiment, the right cursor 52 is provided on the bottom plate 46, in the vicinity of the right side wall 36B. The right cursor 52 abuts on the right side end of the sheet stack stored in the sheet storage portion 41 and positions the sheet stack to the predetermined position. The right cursor 52 is supported by the bottom plate 46 in such a way as to be slidable in the width direction.

Figure 6:
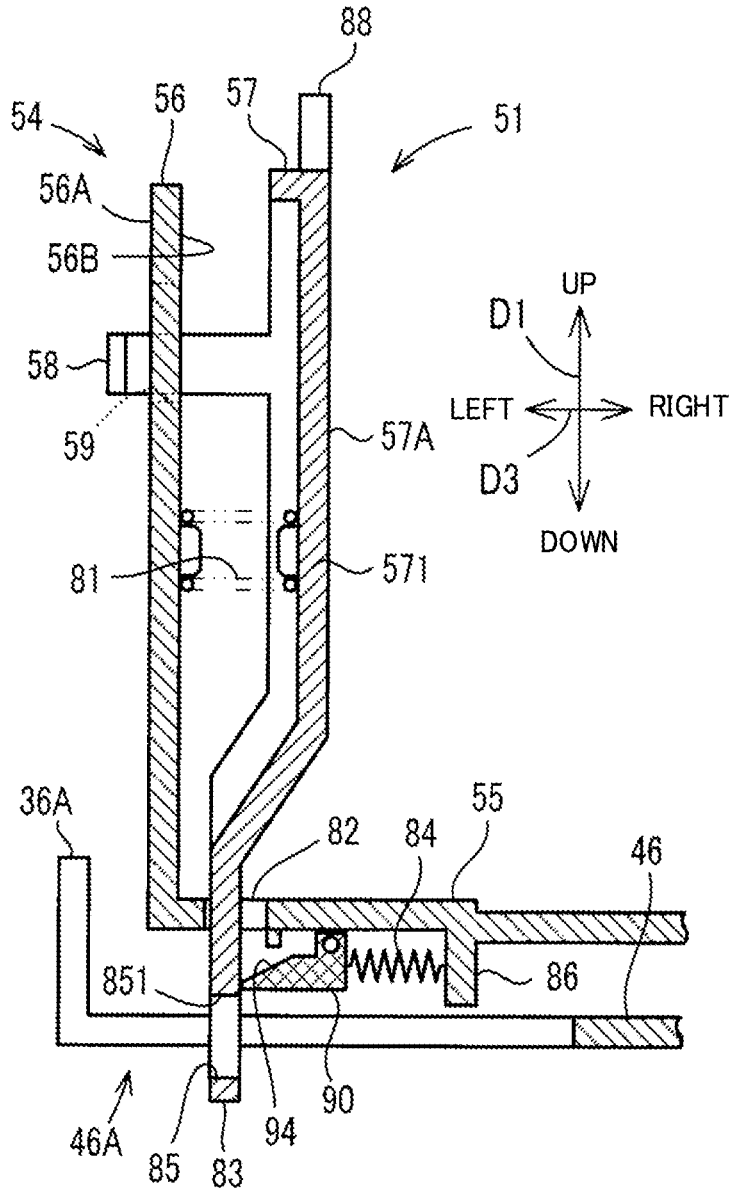
FIG. 6 is a cross section showing a configuration of a left cursor included in the paper cassette.

As shown in FIG. 6, the left cursor 51 includes a moving body 54 and an abutting portion 57, wherein the moving body 54 is configured to move on the upper surface of the bottom plate 46 in the left-right direction D3, and the abutting portion 57 is supported by the moving body 54. The moving body 54 is an example of a moving body of the present invention, and the abutting portion 57 is an example of an abutting portion of the present invention.

The moving body 54 includes a plate-like support plate 55 (an example of a support portion of the present invention)

and a plate-like vertical plate 56 (an example of a side plate portion of the present invention), wherein the support plate 55 is slidably supported by the bottom plate 46, and the vertical plate 56 extends upward approximately in the vertical direction from the support plate 55. The moving body 54 is made of, for example, a synthetic resin, and the support plate 55 and the vertical plate 56 are integrally formed with each other. The support plate 55 extends in the front-rear direction D2 along the upper surface (bottom surface) of the bottom plate 46. An end portion (left end portion) of the sheet stack in the width direction is supported by an upper surface of the support plate 55.

In addition, the abutting portion 57 is supported by the moving body 54. The abutting portion 57 includes a main body portion 571 that is formed in an approximately rectangular shape. An inner side surface of the main body portion 571 is referred to as an abutting surface 57A and abuts on the left side end portion of the sheet stack to position the sheet stack. The abutting portion 57 is a plate-like member extending in the up-down direction D1, and is supported by the moving body 54 such that the main body portion 571 faces an inner side surface 56B of the vertical plate 56.

In the present embodiment, the left cursor 51 is provided on the bottom plate 46, in the vicinity of the left side wall 36A. The left cursor 51 abuts on the left side end of the sheet stack stored in the sheet storage portion 41 and positions the sheet stack to the predetermined position. The left cursor 51 is supported by the bottom plate 46 in such a way as to be slidable in the width direction.

A slide movement mechanism of the left cursor 51 and the right cursor 52 is composed of, for example, support rails (not shown) and rail guides (not shown), wherein the support rails are formed on the bottom plate 46 and the rail guides are provided at front and rear end portions of the support plates 55 and 65. When the rail guides slide along the support rails, the cursors 51 and 52 slide in the width direction on the bottom plate 46. It is noted that the slide movement mechanism of the left cursor 51 and the right cursor 52 is not limited to the above-described configuration, but another movement mechanism may be adopted.

The lift plate 45 is provided on the bottom plate 46 as described above. In addition, cuts are formed in opposite sides of the lift plate 45 in correspondence with the movement range of the cursors 51 and 52 so that the cursors 51 and 52 can move in the width direction on the bottom plate 46. As a result, the cursors 51 and 52 can move in the width direction without being interfered with the lift plate 45.

The pair of cursors 51 and 52 are configured to move in conjunction with each other in the width direction on the bottom plate 46. For example, a rack-pinion mechanism composed of rack gears 53 (see FIG. 7) and a pinion gear (not shown) is adopted as the mechanism for moving the cursors 51 and 52 in conjunction with each other. The rack gears 53 are respectively attached to the cursors 51 and 52, and the pinion gear is rotatably provided on the bottom plate 46. With this mechanism, the operator operates an operation lever 69 that is described below to unlock the right cursor 52 and slides only the right cursor 52 in the width direction. This allows the left cursor 51 to slide in the width direction in conjunction with the movement of the right cursor 52. It is noted that although FIG. 4 shows the rack gears 53 attached to the cursors 51 and 52, other components of the rack-pinion mechanism are not shown in the drawing.

As shown in FIG. 5, the right cursor 52 is provided with the operation lever 69 (an example of a lever portion). The operation lever 69 is provided in the right cursor 52 at a position separated rightward (outward in the width direction) from an outer side surface 66B of the abutting portion 66, the outer side surface 66B being opposed to the abutting surface 66A. The operation lever 69 is operated to slide the right cursor 52, and is a lever-like member elongated approximately in the up-down direction D1. The operation lever 69 is formed from an elastic synthetic resin or the like. An operation portion 75 that is held by the operator is provided at an upper end portion of the operation lever 69.

The operation lever 69 is configured to be displaced between a lock position and an unlock position, wherein the lock position is indicated by the solid line in FIG. 5, and the unlock position is indicated by the dotted line in FIG. 5. Specifically, a displacement portion 76 is provided in a lower end portion of the operation lever 69 to allow for displacement of the operation lever 69. The displacement portion 76 includes an arm 76A that extends toward the abutting portion 66 (leftward) from the lower end portion of the operation lever 69. In addition, a support shaft 76B extending in the front-rear direction D2 is provided at an extension end of the arm 76A. The support shaft 76B is pivotably supported by the outer side surface 66B of the abutting portion 66. This allows the operation lever 69 to pivot around the support shaft 76B between the lock position and the unlock position.

A coil spring 72 is provided between the operation lever 69 and the abutting portion 66. The coil spring 72 is provided above the displacement portion 76 near the lower end portion of the operation lever 69. The coil spring 72 is what is called a compression spring and is disposed in a compressed state between the operation lever 69 and the abutting portion 66. An end of the coil spring 72 is coupled with the abutting portion 66 and another end is coupled with the operation lever 69. The coil spring 72 biases the operation lever 69 from the abutting portion 66 rightward. That is, the coil spring 72 elastically biases the operation lever 69 from the unlock position toward the lock position. As a result, in a state where another external force is not applied, the operation lever 69 is always held at the lock position.

A stopper 79 is provided in the right side of the operation lever 69. The stopper 79 regulates the operation lever 69 biased by the coil spring 72 from being displaced to beyond the lock position. The coil spring 72 is provided as one example, and any biasing member configured to bias the operation lever 69 toward the lock position may be applied instead of the coil spring 72. For example, a torsion coil spring attached to the support shaft 76B may be applied instead of the coil spring 72. In addition, instead of using an elastic biasing member such as the coil spring 72, elasticity of flexible operation lever 69 may be used to bias the operation lever 69 toward the lock position. In such a case, the operation lever 69 may be integrally provided with the abutting portion 66.

A lock claw 78 (an example of a lock piece) projecting downward is provided in a lower end portion of the operation lever 69. The lock claw 78 is used to fix the right cursor 52 to an arbitrary position in the width direction on the bottom plate 46 of the sheet storage portion 41. The lock claw 78 is displaced in the up-down direction D1 with the support shaft 76B as a fulcrum when the operation lever 69 is pivoted between the lock position and the unlock position. The lock claw 78 is formed in the shape of a claw that has a downward acute angle.

An engaging portion 49 including a plurality of engaging grooves 49A (an example of an engaging groove) formed at regular intervals in the width direction, is formed on the bottom plate 46 of the sheet storage portion 41. The engaging portion 49 is formed on the bottom plate 46 in a moving range of the right cursor 52. For example, the lock claw 78 is composed of gear teeth of a predetermined size, and the engaging portion 49 is a rack gear having gear teeth of the same size and the same pitch as those of the lock claw 78.

In the present embodiment, in a state where the operation lever 69 is not operated, the operation lever 69 is located at the lock position, and in this state, the lock claw 78 enters the engaging grooves 49A of the engaging portion 49 and is engaged therewith in the width direction (see FIG. 5). That is, in the state where the operation lever 69 is not operated, the lock claw 78 of the right cursor 52 keeps to be engaged with the engaging grooves 49A of the engaging portion 49. In this state, the right cursor 52 is locked to the bottom plate 46, and cannot move in the width direction.

When the operation portion 75 is operated by the operator, and the operation lever 69 is displaced from the lock position to the unlock position, the lock claw 78 is displaced upward and released from the engaging grooves 49A of the engaging portion 49 (see the dotted line in FIG. 5). This allows the right cursor 52 to be unlocked from the bottom plate 46 and move in the width direction. That is, the unlock position is where the operation lever 69 is located when the fixation of the right cursor 52 to the bottom plate 46 is removed.

As shown in FIG. 6, the abutting portion 57 is supported in such a way as to be displaced in the left-right direction D3 with respect to the vertical plate 56. Specifically, a pair of engaging arms 58 are provided respectively at opposite end portions of the main body portion 571 of the abutting portion 57 in the front-rear direction D2, wherein the engaging arms 58 project from the opposite end portions toward the outside in the width direction (leftward). Hook portions are provided at the tips (projection ends) of the engaging arms 58, wherein the hook portions are each bent like a hook. In addition, openings 59 in which the engaging arms 58 can be inserted, are formed in the vertical plate 56. The hook portions of the engaging arms 58 and the openings 59 are configured to be coupled with each other by the snap fitting, the thickness of the hook portions being slightly smaller than the size of the openings 59. As a result, when the hook portions are pressed and inserted in the openings 59, the hook portions are locked to the peripherals of the openings 59. This allows the abutting portion 57 to be displaced in the left-right direction D3 with respect to the vertical plate 56 within the range of the length of the engaging arms 58.

The openings 59 are long holes that are elongated in the up-down direction D1 and are longer than the size of the engaging arms 58 in the up-down direction D1. As a result, in a state where the engaging arms 58 are inserted in the openings 59, the openings 59 support the abutting portion 57 such that the abutting portion 57 can move in the up-down direction D1 within the range of the size of the openings 59 in the up-down direction D1, and guide the abutting portion 57 in the up-down direction D1. In the present embodiment, as described below, the abutting portion 57 is supported by the moving body 54 so as to be displaced in the up-down direction D1 between a pressed position (the position shown in FIG. 6 and FIG. 14) and a non-pressed position (the position shown in FIG. 15 and FIG. 16), wherein when the abutting portion 57 is located at the pressed position, a projection portion 83, described below, of the abutting portion 57 is pressed by a pressing member 90 described below, and when the abutting portion 57 is located at the non-pressed position, the pressing by the pressing member 90 is removed. Here, when the abutting portion 57 is located at the pressed position, the engaging arms 58 are in contact with lower edge portions of the openings 59. In addition, the non-pressed position is above the pressed position, and when the abutting portion 57 is located at the non-pressed position, the pressing member 90 is inserted in an opening 85 described below.

The left cursor 51 is provided with a coil spring 81 that biases toward the left side end portion of the sheet stack. The coil spring 81 is an example of a first biasing member of the present invention. The coil spring 81 is disposed between the vertical plate 56 and the main body portion 571 of the abutting portion 57. The coil spring 81 biases the abutting portion 57 rightward with respect to the vertical plate 56. As a result, in a state where no other external force is applied to the abutting portion 57, for example, in a state where the pressing member 90 does not press the abutting portion 57, the abutting portion 57 is disposed at a regulating position (the position shown in FIG. 16) where it presses and regulates the left side end portion of the sheet stack by the elastic force of the coil spring 81. It is noted that when the pressing member 90 is inserted in the opening 85 and the abutting portion 57 is located at the non-pressed position, the abutting portion 57 is displaced to the regulating position.

A through hole 82 (an example of a through hole of the present invention) is formed in the support plate 55 of the left cursor 51. The through hole 82 is a hole in which a lower end portion of the abutting portion 57 is inserted, and is elongated in the front-rear direction D2.

The projection portion 83 (an example of an insertion portion of the present invention) projecting downward from the main body portion 571 is provided at the lower end portion of the abutting portion 57. The projection portion 83 is configured to be inserted downward in the through hole 82 of the support plate 55 from the upper surface of the support plate 55. As shown in FIG. 7 to FIG. 10, the projection portion 83 projects downward from the lower end portion of the main body portion 571, is inserted in the through hole 82 from the upper surface of the support plate 55, and projects downward from a lower surface 55A of the support plate 55.

Figure 9:
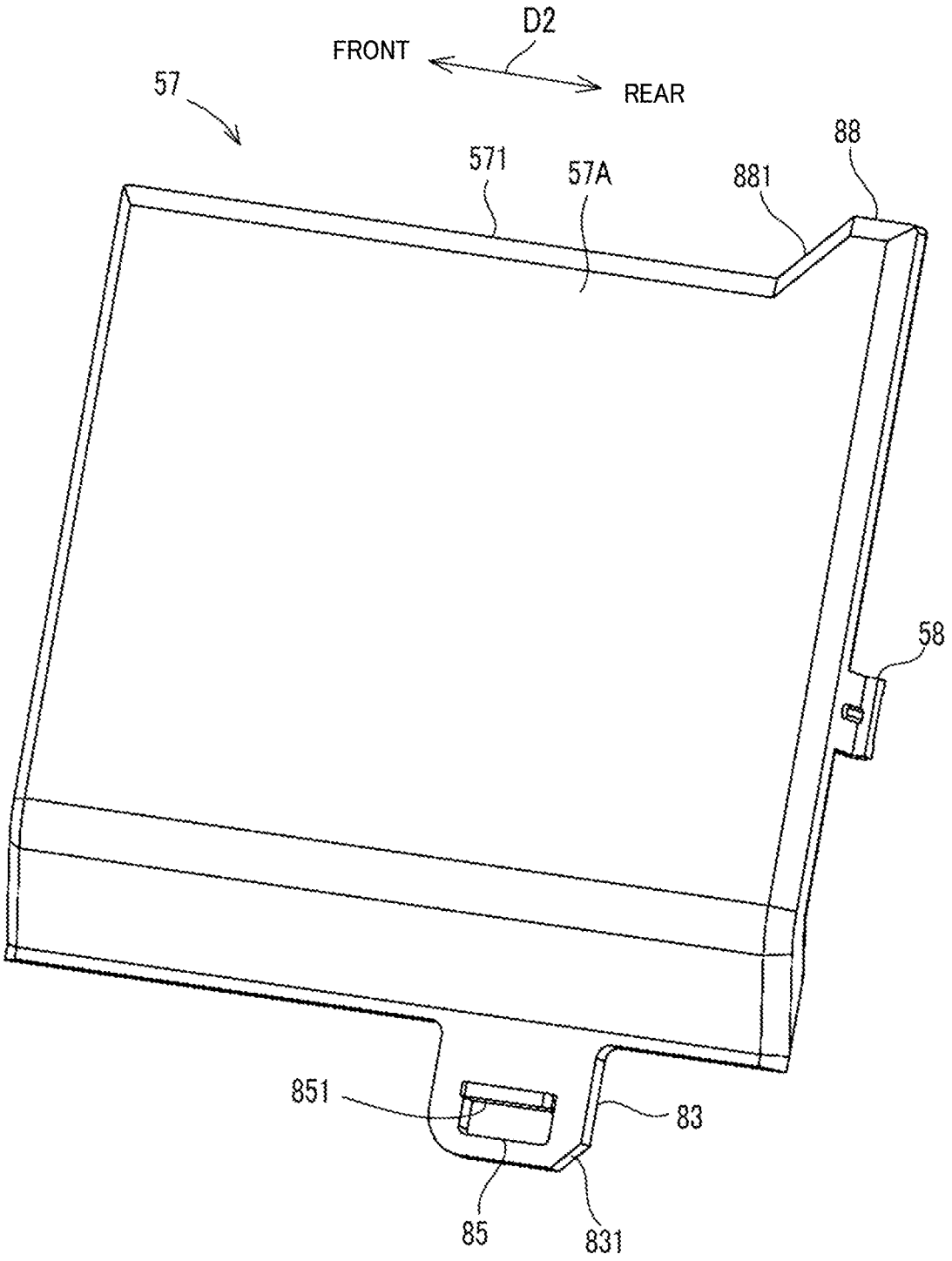
FIG. 9 is a perspective diagram showing an abutting portion of the left cursor.
Figure 10:
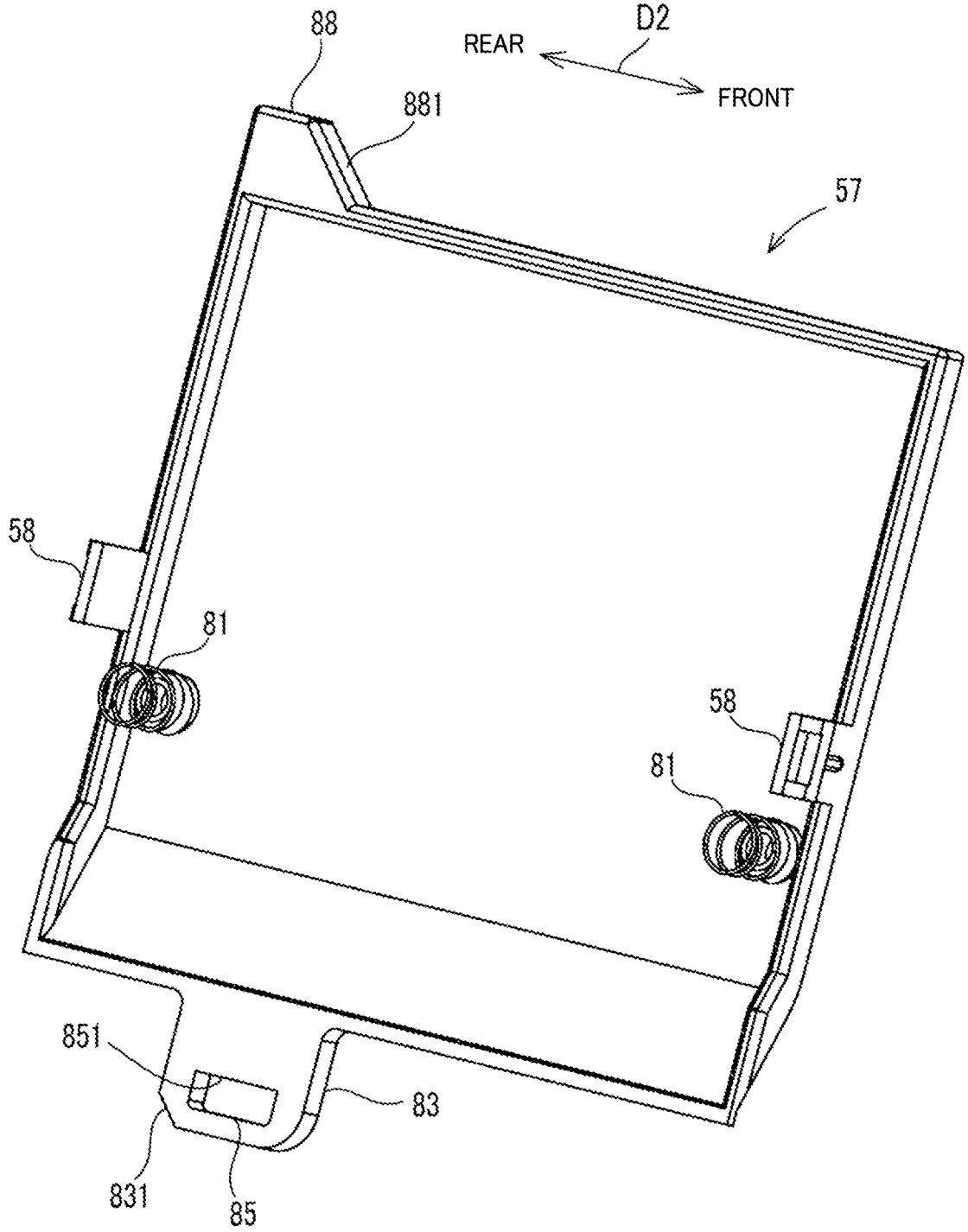
FIG. 10 is a perspective diagram showing the abutting portion of the left cursor.
Figure 12:
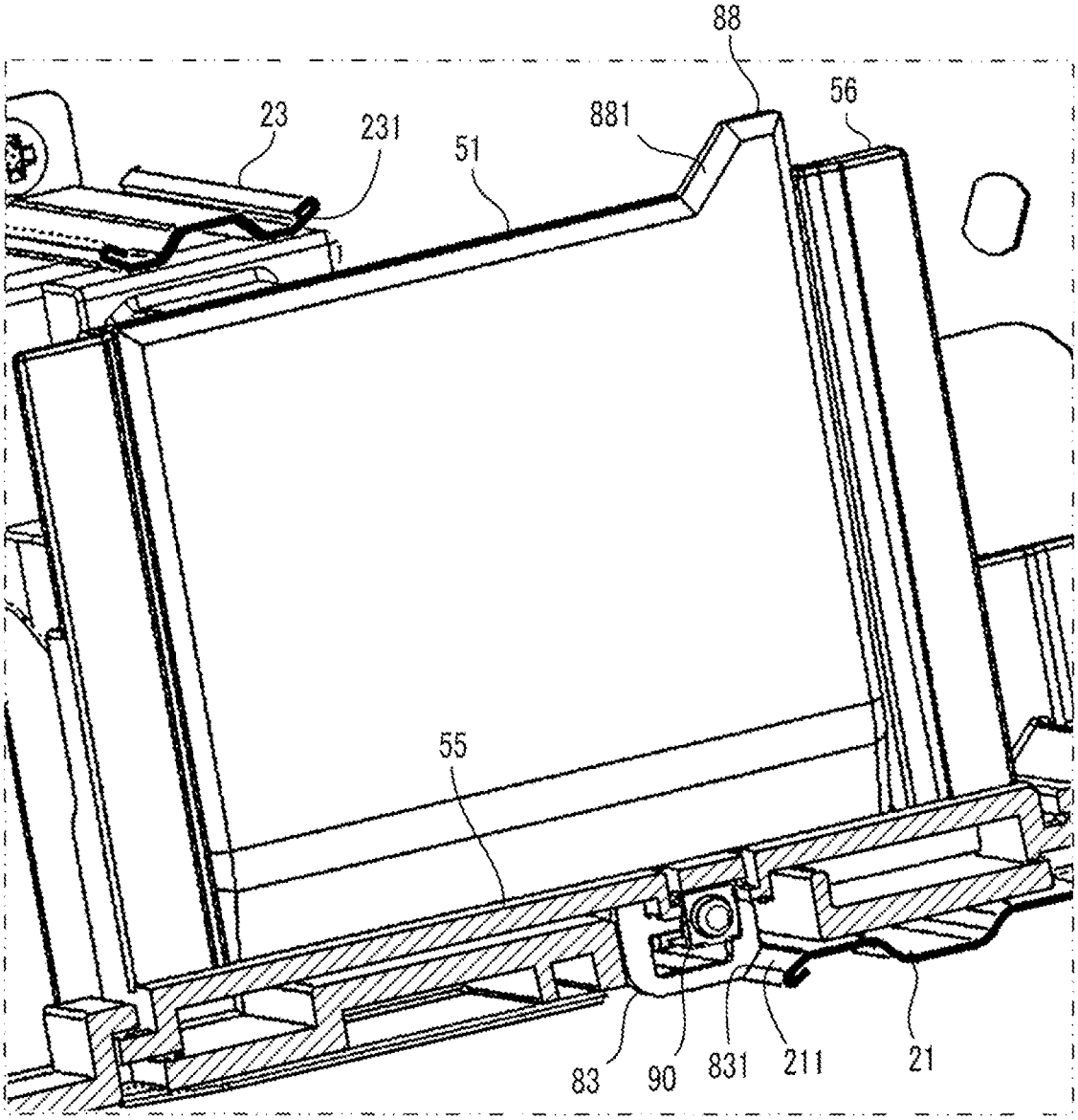
FIG. 12 is a perspective diagram showing a front support frame that comes in contact when the paper cassette is inserted in the housing.

As shown in FIG. 12, the projection portion 83 is configured to, when the paper cassette 17 is inserted in the housing 19, abut on the front support frame 21 of the housing 19 and receive, from the front support frame 21, a force that lifts up the abutting portion 57. As a result, as shown in FIG. 9 and FIG. 10, an inclined surface 831 that is abutted by the front support frame 21 is formed at a corner of the projection portion 83 on the rear side. In addition, an inclined surface 211 (see FIG. 12) is formed on the front support frame 21 at its front-side portion that abuts on the inclined surface 831. With this configuration, an upward force is smoothly transmitted from the front support frame 21 to the projection portion 83. In the present embodiment, when the abutting portion 57 is located at the pressed position, the projection portion 83 abuts on the front support frame 21. In addition, when the abutting portion 57 is located at the non-pressed position, the projection portion 83 does not come in contact with the front support frame 21.

Figure 7:
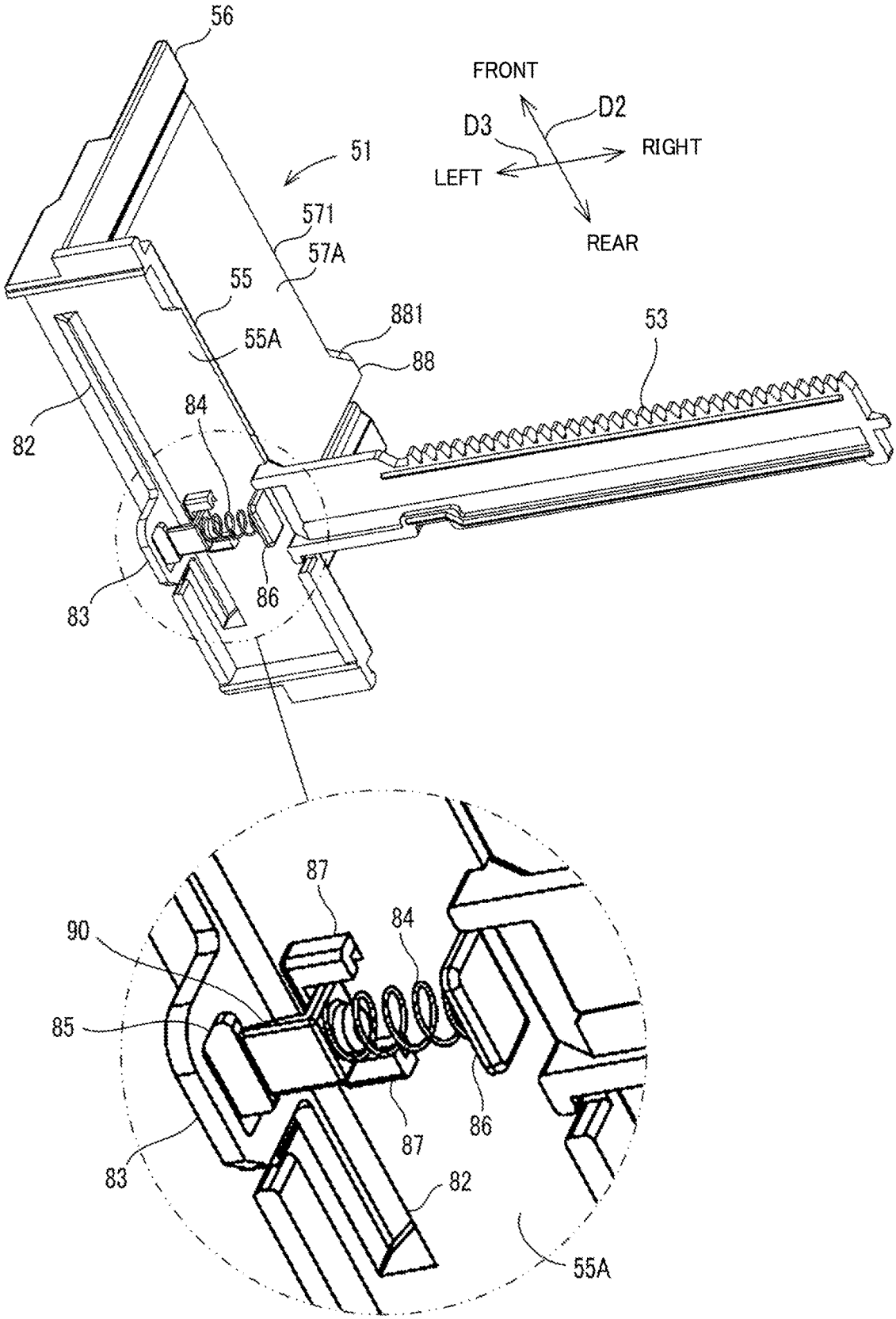
FIG. 7 is a perspective diagram showing a configuration of the left cursor included in the paper cassette.
Figure 8:
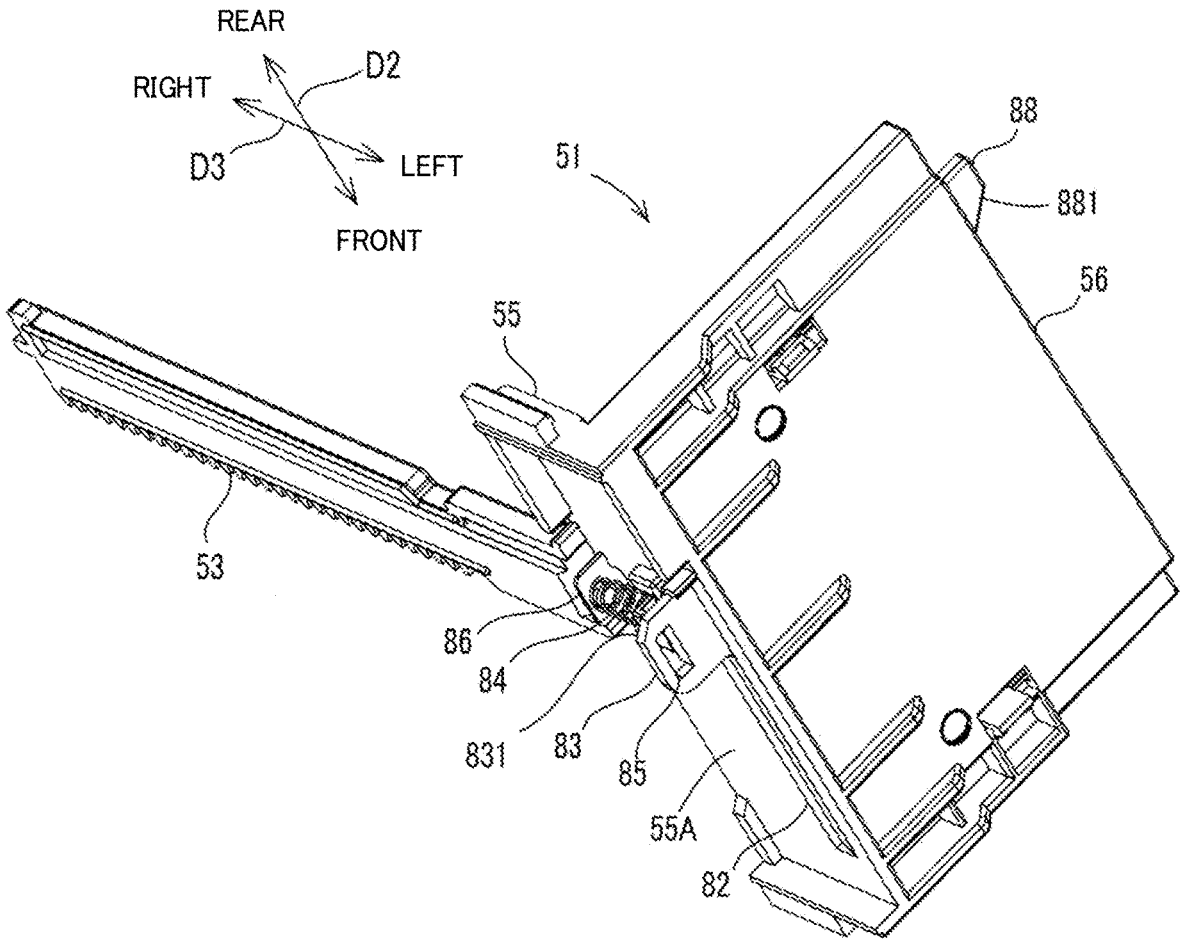
FIG. 8 is a perspective diagram showing a configuration of the left cursor included in the paper cassette.

As shown in FIG. 7 and FIG. 8, the left cursor 51 is provided with a coil spring 84 (an example of an elastic member of the present invention). The coil spring 84 biases the abutting portion 57 in a direction (leftward) opposite to the biasing direction of the coil spring 81 (see FIG. 6). The direction opposite to the biasing direction of the coil spring 81 is an example of a second direction of the present invention. Specifically, the coil spring 84 is attached to the lower surface of the support plate 55 and biases the projection portion 83 of the abutting portion 57 leftward. One end (the right end) of the coil spring 84 is fixed to a fixing portion 86 that projects downward from the lower surface of the support plate 55. The other end (the left end) of the coil spring 84 is attached with a pressing member 90 (an example of a pressing member of the present invention). A second biasing member of the present invention is achieved by the coil spring 84 and the pressing member 90.

The coil spring 84 is what is called a compression spring and is disposed in a compressed state between the fixing portion 86 and the projection portion 83. The pressing member 90 receives an elastic force of the coil spring 84, abuts on a side surface of the projection portion 83, and presses the projection portion 83 leftward. It is noted that the coil spring 84 is used as one example in the present embodiment, but any elastic member configured to apply, to the pressing member 90, an elastic force that presses the projection portion 83 may be used instead of the coil spring 84.

In the present embodiment, an opening 85 (an example of a first opening portion of the present invention) is formed in the projection portion 83. The opening 85 is a through hole piercing through the projection portion 83 in the left-right direction D3, and has a size and shape that allow the pressing member 90 to be inserted therein. As shown in FIG. 6, the pressing member 90 abuts on a portion of the projection portion 83 that is located higher than the opening 85. In this state, an elastic force of the coil spring 84 is applied to the pressing member 90, and the pressing member 90 presses the projection portion 83.

The coil spring 84 applies, to the pressing member 90, an elastic force that is larger than a biasing force of the coil spring 81 that biases the abutting portion 57. As a result, when the biasing force of the pressing member 90 is applied to the abutting portion 57, for example, the abutting portion 57 is pressed by the pressing member 90 leftward, and the abutting portion 57 is displaced toward the vertical plate 56. In this case, the abutting portion 57 cannot press the left side end portion of the sheet stack, and is disposed at a non-regulating position (the position shown in FIG. 6 and FIG. 14) so as not to regulate the left side end portion of the sheet stack. It is noted that the non-regulating position is identical with the pressed position where the abutting portion 57 is disposed when the abutting portion 57 is pressed by the pressing member 90.

Figure 11:
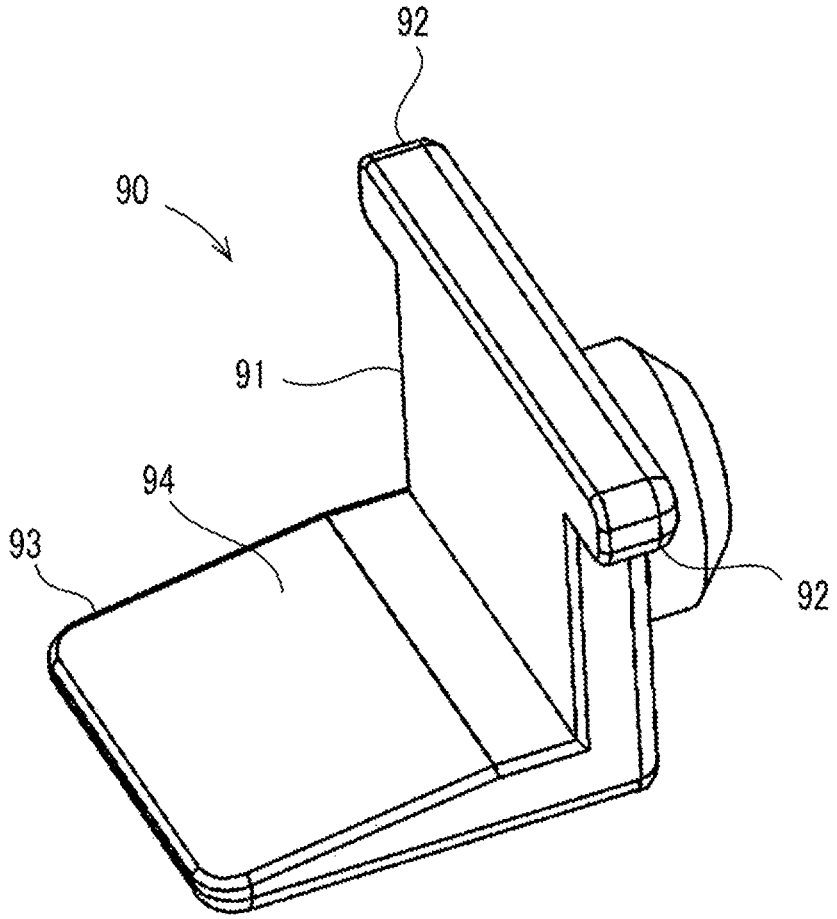
FIG. 11 is a perspective diagram showing a pressing member of the left cursor.

As shown in FIG. 11, the pressing member 90 includes a base portion 91, a support shaft 92, and a projection portion 93, wherein the base portion 91 is plate-like, the support shaft 92 is provided at an upper end of the base portion 91, and the projection portion 93 projects horizontally from a lower end of the base portion 91. The support shaft 92 is supported by a slide guide 87 that is formed on the lower surface 55A of the support plate 55. The slide guide 87 includes a guide groove that extends in a direction in which the coil spring 84 expands and contracts, and the support shaft 92 is inserted in the guide groove. This allows the pressing member 90 to slide in the direction in which the coil spring 84 expands and contracts.

The projection portion 93 is formed plate-like. An upper surface of the projection portion 93 is an inclined surface 94 that is inclined from the base portion 91 toward the tip. The inclined surface 94 abuts on an edge portion 851 located above the opening 85 when the abutting portion 57 is displaced from the non-pressed position (see FIG. 15, FIG. 16) to the pressed position (see FIG. 6, FIG. 14). When the abutting portion 57 is displaced from the non-pressed position to the pressed position, the edge portion 851 slides relatively on the inclined surface 94 and thereby pushes back the pressing member 90 in an opposite direction to the biasing force of the coil spring 84.

As shown in FIG. 6, an opening 46A (an example of a second opening portion of the present invention) is formed in the bottom plate 46 of the sheet storage portion 41. The opening 46A is a cut portion formed in the bottom plate 46 by being cut from the side wall 36A toward the center in the left-right direction D3, and is formed at a position corresponding to the through hole 82. The projection portion 83 that pierces through the through hole 82 and projects downward from the lower surface 55A of the support plate 55, also pierces through the opening 46A of the bottom plate 46 and projects downward from the lower surface of the bottom plate 46. As a result, the opening 46A is formed in a size and at a position in the bottom plate 46 such that when the left cursor 51 moves in the left-right direction D3 on the bottom plate 46, the projection portion 83 does not interfere with the bottom plate 46.

In addition, as shown in FIG. 9 and FIG. 10, a projection portion 88 is provided on the abutting portion 57. The projection portion 88 projects upward from an upper end of the main body portion 571. The projection portion 88 is provided on the rear side of the upper end of the main body portion 571. Specifically, the projection portion 88 is provided in the downstream of the projection portion 83 in a direction in which the paper cassette 17 is inserted in the housing 19.

The projection portion 88 is configured to, when the paper cassette 17 is drawn out from the housing 19, abut on the reinforcement frame 23 of the housing 19 and receive, from the front support frame 21, a force that pushes down the abutting portion 57. As a result, as shown in FIG. 9 and FIG. 10, an inclined surface 881 that is abutted by the reinforcement frame 23 is formed at a corner of the projection portion 88 on the front side. In addition, an inclined surface 231 (see FIG. 12) is formed on the reinforcement frame 23 at its rear-side portion that abuts on the inclined surface 881. With this configuration, a downward force is smoothly transmitted from the reinforcement frame 23 to the projection portion 88. In the present embodiment, when the abutting portion 57 is located at the non-pressed position (see FIG. 15, FIG. 16), the projection portion 88 abuts on the reinforcement frame 23. In addition, when the abutting portion 57 is located at the pressed position, the projection portion 88 does not come in contact with the reinforcement frame 23.

Figure 13:
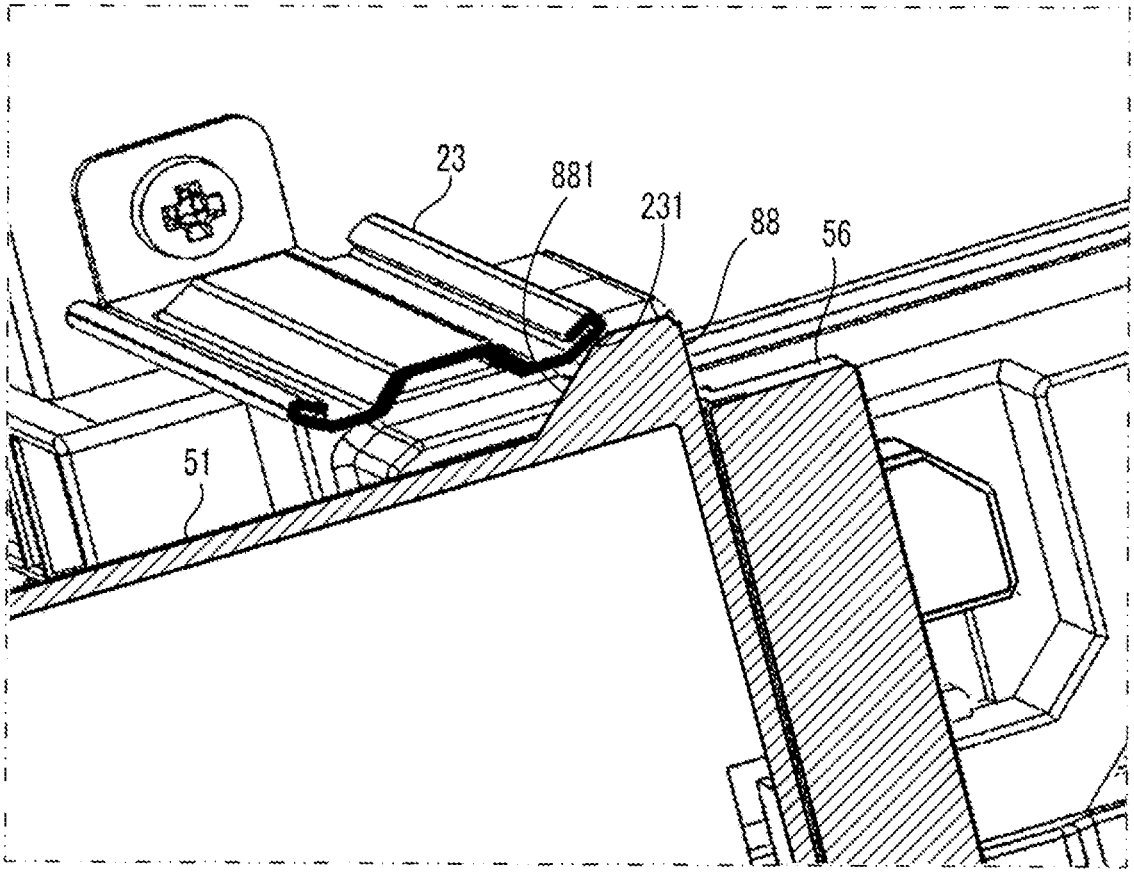
FIG. 13 is a perspective diagram showing a reinforcement frame that comes in contact when the paper cassette is drawn out from the housing.
Figure 14:
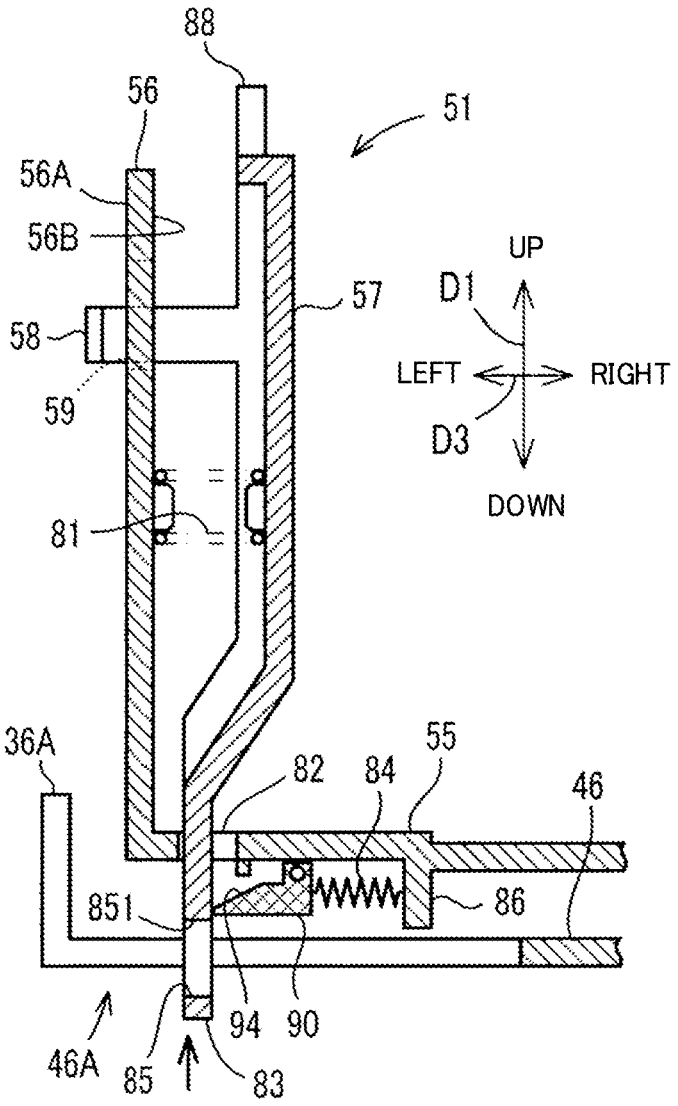
FIG. 14 is a cross section showing an operation of the left cursor, and shows a state where the left cursor is pressed by the pressing member.
Figure 15:
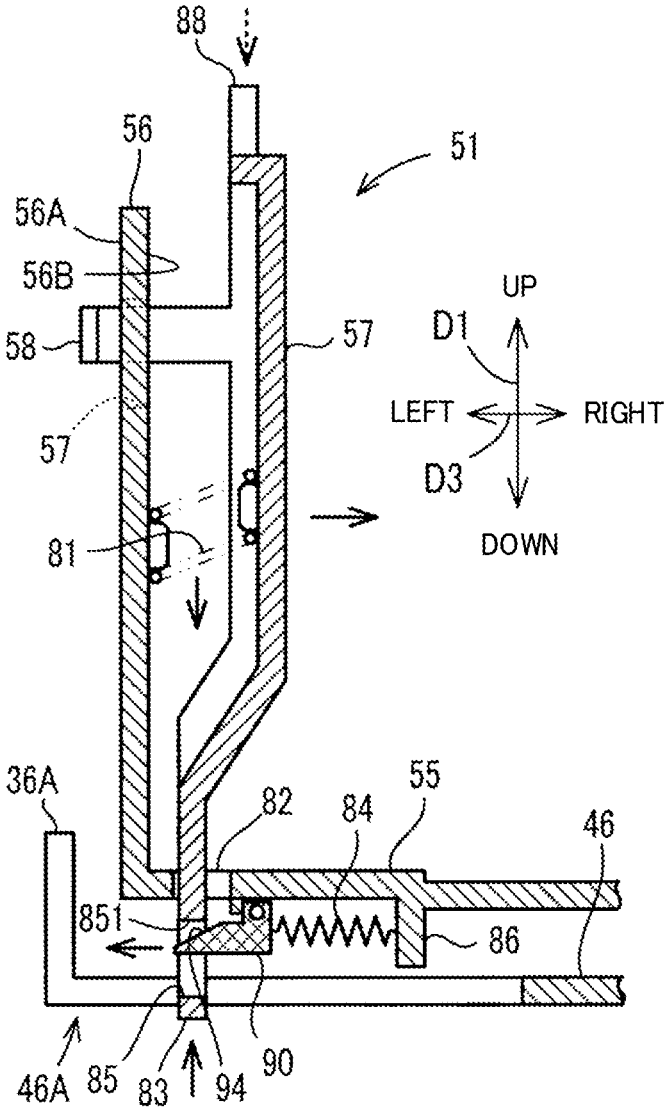
FIG. 15 is a cross section showing an operation of the left cursor, and shows a state where pressing by the pressing member has been removed.
Figure 16:
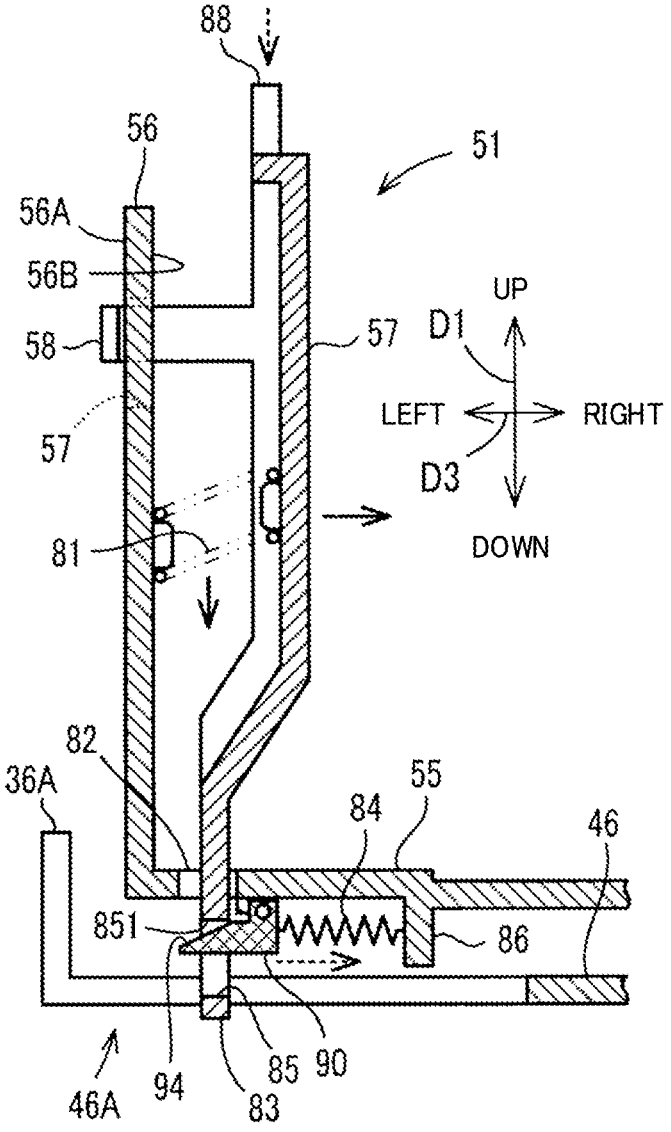
FIG. 16 is a cross section showing an operation of the left cursor, and shows a state where the left cursor is abutting on a side of a sheet stack.

The following describes, with reference to FIG. 12 to FIG. 16, how the left cursor 51 operates when the paper cassette 17 is inserted in the housing 19. It is supposed in the following description that the paper cassette 17 has been drawn out from the housing 19, and the abutting portion 57 is located at the pressed position. Here, FIG. 12 shows a state where the projection portion 83 comes in contact with the front support frame 21 when the paper cassette 17 is inserted in the housing 19. FIG. 13 shows a state where the projection portion 88 comes in contact with the reinforcement frame 23 when the paper cassette 17 is drawn out from the housing 19. FIG. 14 to FIG. 16 show operations of the left cursor 51.

As shown in FIG. 14, when the abutting portion 57 is located at the pressed position, the tip of the pressing member 90 abuts on a portion above the opening 85, and the pressing member 90 presses the abutting portion 57. When the paper cassette 17 is inserted in the housing 19, the projection portion 88 provided at the upper end of the abutting portion 57 passes below the reinforcement frame 23. As shown in FIG. 12, when the paper cassette 17 is further inserted, the inclined surface 831 of the projection portion 83 comes in contact with the inclined surface 211 of the front support frame 21 in the insertion process.

When the paper cassette 17 is further inserted in the insertion direction, an upward force is applied to the projection portion 83 by the contact between the projection portion 83 and the front support frame 21. This allows the abutting portion 57 that has been located at the pressed position (see FIG. 14), to be displaced upward and move to the non-pressed position shown in FIG. 15. At this time, the tip of the pressing member 90 enters the opening 85, and the pressing of the abutting portion 57 by the pressing member 90 is removed. In addition, the pressing member 90 pierces through the opening 85, and the abutting portion 57 is supported by the pressing member 90. This allows the abutting portion 57 to be maintained at the non-pressed position even after the projection portion 83 passes through the front support frame 21.

After the pressing by the pressing member 90 is removed, the abutting portion 57 receives the biasing force of the coil spring 81 and moves toward the left end portion of the sheet stack, and is displaced from the non-pressed position to the pressed position shown in FIG. 16. In this state, the abutting portion 57 regulates the left end portion of the sheet stack and positions the sheet stack to a predetermined position. The opening 85 that removes the pressing by the pressing member 90 as described above is an example of a bias removing portion of the present invention.

Next, the following describes how the left cursor 51 operates when the paper cassette 17 is drawn out from the housing 19.

After the paper cassette 17 is attached to the housing 19, the abutting portion 57 is located at the non-pressed position. In this state, when the paper cassette 17 is drawn out from the housing 19, the projection portion 83 provided at the lower end of the abutting portion 57 passes above the front support frame 21. As shown in FIG. 13, when the paper cassette 17 is further drawn out, the inclined surface 881 of the projection portion 88 comes in contact with the inclined surface 231 of the reinforcement frame 23 in the drawn-out process. When the paper cassette 17 is further pulled in the drawn-out direction, a downward force (see the dotted-line arrow in FIG. 16) is applied to the projection portion 88 by the contact between the projection portion 88 and the reinforcement frame 23. At this time, the edge portion 851 of the opening 85 comes in contact with the inclined surface 94 of the pressing member 90, and presses the inclined surface 94 downward. This allows a force (see the dotted-line arrow in FIG. 16) to act on the pressing member 90 in a direction in which the pressing member 90 comes off the opening 85. Upon receiving the force, the pressing member 90 comes off the opening 85, and the abutting portion 57 is lowered up to the pressed position. This allows the abutting portion 57 to be pressed by the pressing member 90 again. In this state, the abutting portion 57 is separated from the left end portion of the sheet stack, and is located at a position where it cannot regulate the left end portion.

With the above-described configuration of the left cursor 51, when an upward force is applied to the projection portion 83 of the abutting portion 57 in a state where the abutting portion 57 is located at the pressed position, the abutting portion 57 is displaced from the non-regulating position to the regulating position. The user moves the cursors 51 and 52 to predetermined positions in advance and stores the print sheets in the paper cassette 17 after it has become empty. In such a case, with the above-described configuration, even if there is a small gap between the cursors 51 and 52 and the print sheets, the abutting portion 57 is displaced to the regulating position during the insertion of the paper cassette 17 into the housing 19. As a result, to store the print sheets in the paper cassette 17, there is no need to spread the space between the cursors 51 and 52 in advance to be wider than the space between the predetermined positions, and there is no need to move the cursors 51 and 52 to the predetermined positions thereafter, either. As a result, the print sheets can be set in the paper cassette 17 easily, and the paper cassette 17 can be inserted with excellent operability.

It is noted that the present embodiment discloses, as one example, a configuration where the abutting portion 57 is displaced upward by a force applied thereto from the front support frame 21 when the paper cassette 17 is inserted, and the abutting portion 57 is displaced downward by a force applied thereto from the reinforcement frame 23 when the paper cassette 17 is drawn out. However, the present invention is not limited to the configuration. For example, when the user stores print sheets in the paper cassette 17, the user him/herself may remove the pressure from the abutting portion 57 by displacing the abutting portion 57 upward by operating the projection portion 83. In addition, after storing the print sheets, the user may restore the pressure to the abutting portion 57 by displacing the abutting portion 57 downward by operating the projection portion 88.

In addition, the above-described embodiment discloses, as one example, a configuration where the left cursor 51 includes the abutting portion 57 and the pressing member 90. However, not limited to the configuration, for example, each of the left cursor 51 and the right cursor 52 may include the abutting portion 57 and the pressing member 90. In addition, the above-described embodiment discloses, as one example, a configuration where the operation lever 69 is provided in the right cursor 52. However, not limited to the configuration, for example, the operation lever 69 may be provided in the left cursor 51 together with the abutting portion 57 and the pressing member 90.

In addition, the above-described embodiment discloses, as one example, a configuration where the present invention is applied to the left cursor 51 of the paper cassette 17. However, not limited to the configuration, for example, the cursor 14A of the image reading device 11 may be constituted in the same manner as the left cursor 51.

In addition, the above-described embodiment discloses, as one example, a configuration where the abutting portion 57 moves between the non-regulating position and the regulating position along the left-right direction D3 approximately horizontally. However, the present invention is not limited to the configuration. For example, the abutting portion 57 may move between the non-regulating position and the regulating position by swinging around the lower end portion of the abutting portion 57.

The invention claimed is:

1. A sheet storage device comprising:

a sheet positioning member provided on a sheet placing surface in such a way as to be movable in a predetermined first direction, the sheet positioning member positioning a sheet placed on the sheet placing surface by abutting on a side end portion of the sheet at a side in the first direction, wherein the sheet positioning member includes:

a moving body configured to move in the first direction on the sheet placing surface;

an abutting portion supported by the moving body in such a way as to be movable in the first direction and configured to abut on the side end portion when the sheet positioning member positions the sheet;

a first biasing member configured to bias the abutting portion toward the side end portion;

a second biasing member configured to bias the abutting portion in a second direction opposite to a biasing direction of the first biasing member against a biasing force of the first biasing member; and a bias removing portion configured to remove a bias applied by the second biasing member.

2. The sheet storage device according to claim 1, wherein the second biasing member includes:

an elastic member disposed between the moving body and the abutting portion; and a pressing member configured to, upon receiving an elastic force from the elastic member, press the abutting portion in the second direction, wherein the bias removing portion is formed in the abutting portion and includes a first opening portion that allows the pressing member to be inserted therein, and the abutting portion is supported by the moving body in such a way as to be displaced between a pressed position and a non-pressed position, wherein when the abutting portion is located at the pressed position, pressing by the pressing member is possible, and when the abutting portion is located at the non-pressed position, the pressing member is inserted in the first opening portion and the pressing by the pressing member is removed.

3. The sheet storage device according to claim 2, wherein the pressing member includes an inclined surface, and when the abutting portion is displaced from the non-pressed position to the pressed position, an edge portion of the first opening portion slides on the inclined surface to push back the pressing member in an opposite direction to a biasing force of the elastic member.

4. The sheet storage device according to claim 2, wherein the moving body includes:

a plate-shaped support portion supported by the sheet placing surface in such a way as to be movable in the first direction;

a side plate portion extending upward from the support portion and facing the abutting portion; and a through hole formed in the support portion, the abutting portion is a plate-shaped member extending in an up-down direction, the abutting portion is supported by the moving body in such a way as to be movable in the up-down direction, and includes an insertion portion that is configured to be inserted in the through hole and is provided at a lower end portion of the abutting portion, and the second biasing member is attached to a lower surface of the support portion.

5. The sheet storage device according to claim 4, further comprising:

a sheet storage portion including a bottom plate whose upper surface includes the sheet placing surface, the sheet storage portion configured to store the sheet stacked on the sheet placing surface, wherein the sheet positioning member is supported by the bottom plate in such a way as to be movable in the first direction, a second opening portion is formed in the bottom plate at a position corresponding to the through hole such that the insertion portion can be inserted in the second opening portion and the second opening portion extends along the first direction, and in a state where the abutting portion is located at the pressed position, the insertion portion pierces through the second opening portion and projects downward from a lower surface of the bottom plate.

6. The sheet storage device according to claim 5, further comprising:

a housing that supports the sheet storage portion in a detachable manner; and a first member provided in the housing and configured to, when the sheet storage portion is inserted in the housing, abut on the insertion portion and displace the abutting portion from the pressed position to the non-pressed position.

7. The sheet storage device according to claim 6, wherein the abutting portion includes a projection portion that projects from an upper end edge of the abutting portion at a downstream of the insertion portion in a direction in which the sheet storage portion is inserted, the sheet storage device further comprises a second member provided in the housing and configured to, when the sheet storage portion is drawn out from the housing, abut on the projection portion and displace the abutting portion from the non-pressed position to the pressed position, and in a case where the sheet storage portion has been inserted in the housing, the abutting portion is located at the non-pressed position, and in a state where the sheet storage portion has been drawn out from the housing, the abutting portion is located at the pressed position.

8. An image processing apparatus comprising:

the sheet storage device according to claim 1; and an image processing portion configured to perform image processing on the sheet fed from the sheet storage device.

9. A sheet positioning member that is provided on a sheet placing surface in such a way as to be movable in a predetermined first direction, and positions a sheet placed on the sheet placing surface by abutting on a side end portion of the sheet at a side in the first direction, the sheet positioning member comprising:

a moving body supported by the sheet placing surface in such a way as to be movable in the first direction;

an abutting portion supported by the moving body in such a way as to be movable in the first direction and configured to abut on the side end portion when the sheet positioning member positions the sheet;

a first biasing member configured to bias the abutting portion toward the side end portion;

a second biasing member configured to bias the abutting portion in a second direction opposite to a biasing direction of the first biasing member against a biasing force of the first biasing member; and a bias removing portion configured to remove a bias applied by the second biasing member.

* * * * *